US005340131A

United States Patent [19]

Smathers et al.

[11] Patent Number: 5,340,131

[45] Date of Patent: * Aug. 23, 1994

[54] HYDRAULIC BRAKING SYSTEM FOR IN-LINE ROLLER SKATES

[75] Inventors: David R. Smathers, 200 W. Arlington, Gladstone, Oreg. 97027; Jeffrey J. Smathers, San Jose, Calif.

[73] Assignee: David R. Smathers, Gladstone, Oreg.

[ * ] Notice: The portion of the term of this patent subsequent to Jan. 25, 2011 has been disclaimed.

[21] Appl. No.: 63,647

[22] Filed: May 20, 1993

Related U.S. Application Data

[63] Continuation-in-part of Ser. No. 934,023, Aug. 21, 1992, Pat. No. 5,280,930.

[51] Int. Cl.[5] ..... A63G 17/14

[52] U.S. Cl. ..... 280/112; 280/11.22

[58] Field of Search ..... 280/11.2, 11.22, 11.19, 280/842, 870.41, 870,42; 188/344

[56] References Cited

U.S. PATENT DOCUMENTS 4,943,075 7/1990 Gates ..... 280/842

5,192,088 3/1993 Yu ..... 280/11.22

5,192,099 3/1993 Riutta ..... 280/11.22

FOREIGN PATENT DOCUMENTS 1015536 10/1952 France ..... 280/842

*Primary Examiner*—Richard M. Camby

*Attorney, Agent, or Firm*—Chernoff, Vilhauer, McClung & Stenzel

[57] ABSTRACT

A braking system for a pair of in-line roller skates has a single hand-operated hydraulic actuator which is coupled through a Y coupling to a hydraulic brake assembly on each of the skates for applying braking force simultaneously to opposite sides of a roller on each of the skates. Each hydraulic brake assembly includes a rod extending longitudinally above the rollers to which is connected at least one resilient expander bow, each end of which contacts an engagement caliper. Two engagement calipers are hingedly mounted on the skate housing to apply frictional pressure simultaneously to generally opposite sides of each of the rollers on each of the skates.

9 Claims, 4 Drawing Sheets

HYDRAULIC BRAKING SYSTEM FOR IN-LINE ROLLER SKATES

This application is a continuation-in-part of U.S. Pat. application Ser. No. 07/934,023 filed Aug. 21, 1992 now U.S. Pat. No. 5,280,930.

BACKGROUND OF THE INVENTION

The following invention relates to a braking system for roller skates and in particular to a hydraulic braking system for use with roller skates of the in-line variety.

In recent years in-line roller skates have achieved great popularity. Such skates are characterized by a plurality of rollers mounted at the bottom of a shoe or boot where the rollers are situated one behind the other along the directional line of travel of the skate. Thus, the rollers appear to simulate the blade of an ice skate. Such skates are marketed under the brand name ROLLERBLADE TM.

A problem common to all types of roller skates, including in-line roller skates and skateboards, is the difficulty in slowing down. Thus, various braking systems have been proposed for roller skates and skateboards but none is entirely satisfactory. Conventional braking systems for skateboards which use a foot actuated brake that applies a frictional member against a roller are shown in Waddel U.S. Pat. No. 3,385,608, Sakwa U.S. Pat. No. 3,288,251, and Maurer U.S. Pat. No. 4,003,582. The aforementioned systems use some type of leveraged brake pad bearing directly against a roller or wheel and controlled through a foot actuated mechanical link. While such systems may be practical for skateboards where the user has the ability to shift foot position from one point to another on the skateboard, such a system is not practical for roller skates where the user's feet are encased in special boots.

A hand actuated hydraulic system for a skateboard is proposed in Dungan U.S. Pat. No. 4,295,547. The Dungan system, however, is uniquely adapted for use on skateboards, with side-by-side roller pairs and in order to work properly, requires a special outer stationary brake assist.

What is still needed is a practical hydraulic braking system for use with in-line roller skates.

SUMMARY OF THE PRESENT INVENTION

The present invention provides a practical braking system for in-line roller skates of the type in which each roller skate includes a plurality of rollers situated one behind the other along a line of directional travel of the skate. A single hand-operated hydraulic actuator is coupled to each of a pair of roller skates by a hydraulic conduit system and each of the skates includes at least one hydraulic brake for applying braking force simultaneously to generally opposite sides of at least one of the rollers.

Hydraulic brake assemblies, one for each skate, are controlled simultaneously by the hand-held hydraulic actuator through a Y or T coupling that includes two output lines, one of which is connected to each of the roller skates. The Y coupling can be held against the user's body by a belt or the like at the small of the back so that the hydraulic lines emanating from the coupling may extend down along the user's legs to each respective roller skate.

The hand-held actuator may comprise a body and plunger combination in which the plunger actuates a hydraulic cylinder to pump hydraulic fluid to the brakes.

As is conventional with roller skates of this type, the individual rollers are mounted on axial shafts that extend between the walls of a housing which extends along either side of the sidewalls of the rollers. Each of the hydraulic brake assemblies includes a hydraulic cylinder and piston which may be mounted at the rear of the skate. Each piston is coupled to a rod extending longitudinally above the rollers and to which is coupled at least one resilient expander bow. Each end of the resilient expander bow contacts an engagement caliper which is pivotally mounted on the housing to apply frictional pressure simultaneously to generally opposite sides of a roller. There may be a plurality of expander bows coupled to the rod and these may engage calipers mounted to apply braking force to each of the rollers.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
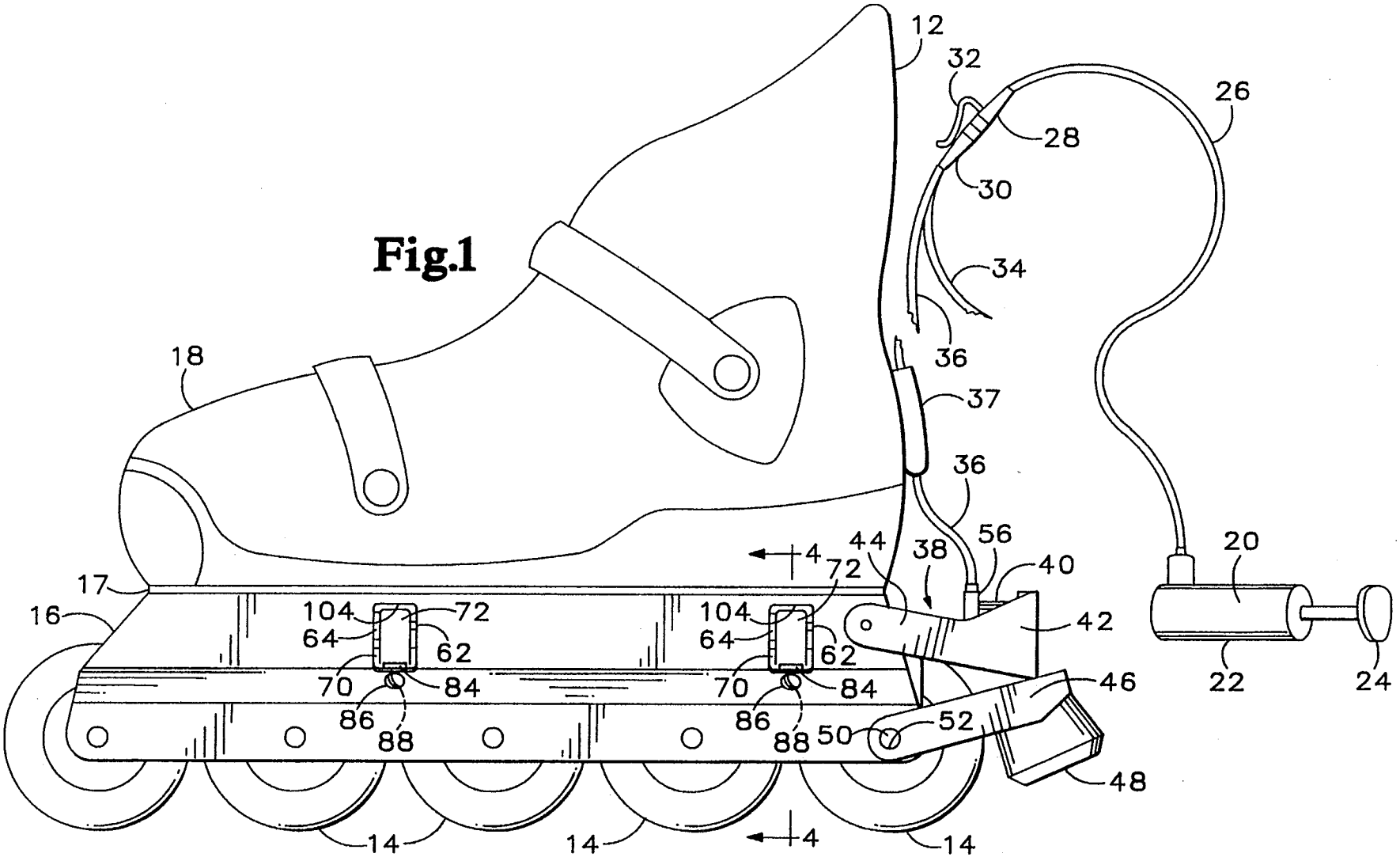
FIG. 1 is a side elevation view of an in-line roller skate embodying the present invention.

A braking system for a pair of in-line roller skates is provided for a pair of roller skates 12. These roller skates are of the in-line variety such as those commonly sold under the trade name ROLLERBLADE TM. Each skate 12 includes a plurality of rollers 14 arranged in a straight line along the direction of travel of the skate. The rollers are located underneath the skate 12 in a housing 16 which is fastened to the bottom 17 of a boot 18.

Figure 8:
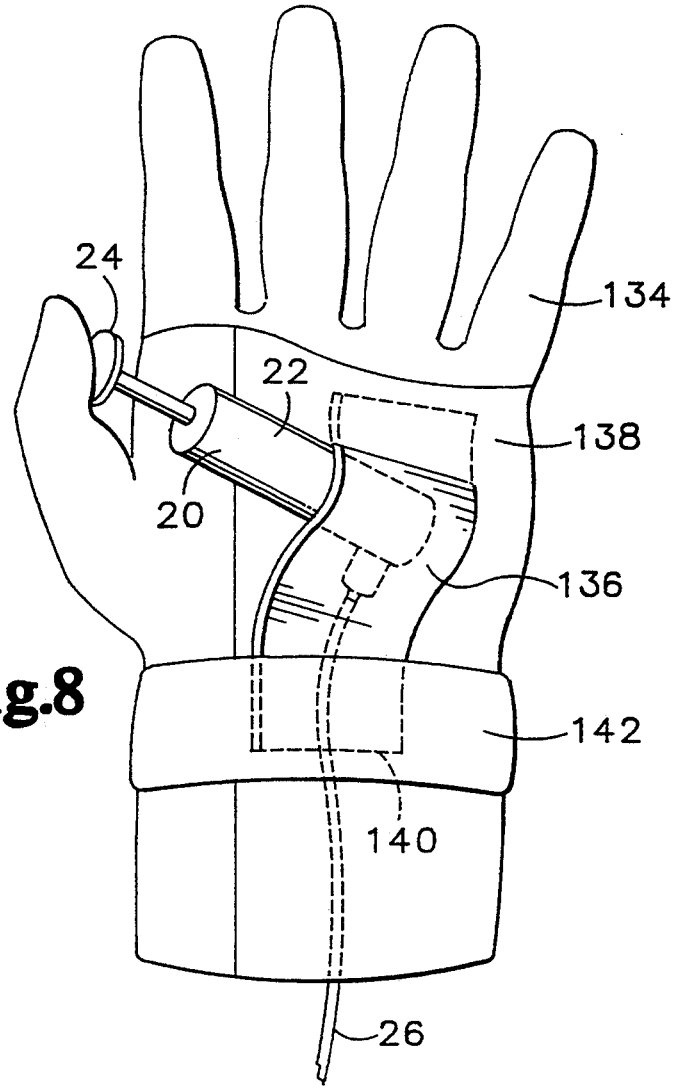
FIG. 8 is a perspective view of the hand-held actuator of FIG. 1 shown with a gloved hand.

The braking system of the invention includes a hand-held hydraulic actuator 20 that includes a hydraulic cylinder (not shown) which is internal to a body portion 22. The hydraulic cylinder is worked by a thumb-depressible plunger 24 which is coupled to the body portion 22. As shown in FIG. 8, a glove 134 includes a brace 136 which projects from a reinforced palm area 138, and which is additionally secured at one end 140 by a strap 142 attachable with hook-and-loop fastener material, for supporting the body portion 22 of the actuator 20. The glove and brace thus aid the user in grasping and using the hand-held actuator. The brace is made of a rigid polymeric material. The glove is made of a tough skid-resistant material such as Kevlar, and alternatively, may cover only a portion of the hand leaving, for example, the ends of the fingers and thumb free.

The actuator 20 and the hydraulic cylinder are in essence a hydraulic pump which pumps hydraulic fluid through a conduit 26 to a Y coupler 28. The Y coupler 28 is contained in a housing 30 which may be affixed by a clip 32 to the wearer's belt or the like near the small of the back or on the side. The output lines of the Y coupler 28 are a pair of hydraulic fluid conduits 34 and 36 which are respectively secured to the back of the boot 18 by a guide 37 on each of the skates 12.

Figure 6:
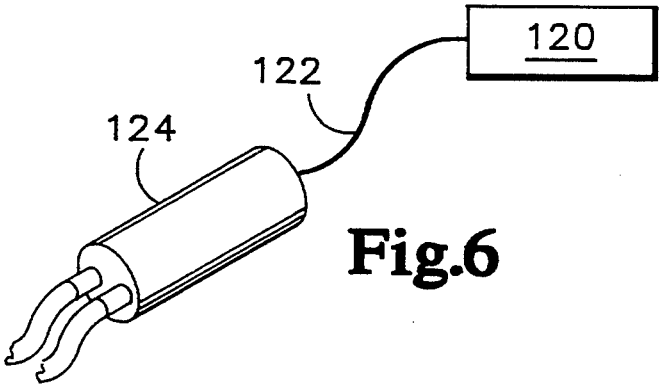
FIG. 6 is an alternative embodiment of the hand-held hydraulic actuator shown in FIG. 1.

Alternatively, as shown in FIG. 6, the hand-held hydraulic actuator 120 includes a mechanical link such as a wire link 122 to a hydraulic cylinder (not shown) which is internal to the Y coupler 124.

Figure 7:
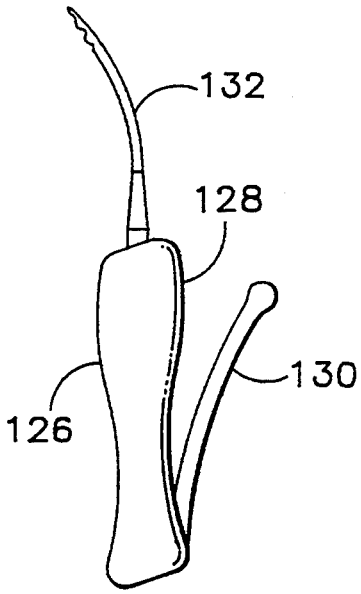
FIG. 7 is an alternative embodiment of the hand-held hydraulic actuator shown on FIG. 1.

As shown in FIG. 7, the hand-held hydraulic actuator 126 includes a hydraulic cylinder (not shown) which is internal to a pistol-grip handle portion 128. The hydraulic cylinder is worked by a lever 130, which pumps hydraulic fluid through a conduit 132 to a Y coupler 28.

The hand-held hydraulic actuator 126 is similar to the hand-held actuator disclosed in U.S. Pat. application Ser. No. 07/934,023 filed Aug. 21, 1992, the complete specification of which is hereby incorporated by reference.

Each hydraulic fluid conduit 34 or 36 is coupled to a hydraulic brake assembly 38 which includes a hydraulic cylinder 40 that is mounted at the rear of the skate 12 on a bracket 42 having upper 44 and lower 46 bracket arms. The lower bracket arm 46 also supports a drag brake 48 and is secured by a bolt 50 which extends through a hole 52 in the housing 16. The bolt 50 passes through a bushing 54 and provides the axial shaft for mounting the roller 14.

Figure 2:
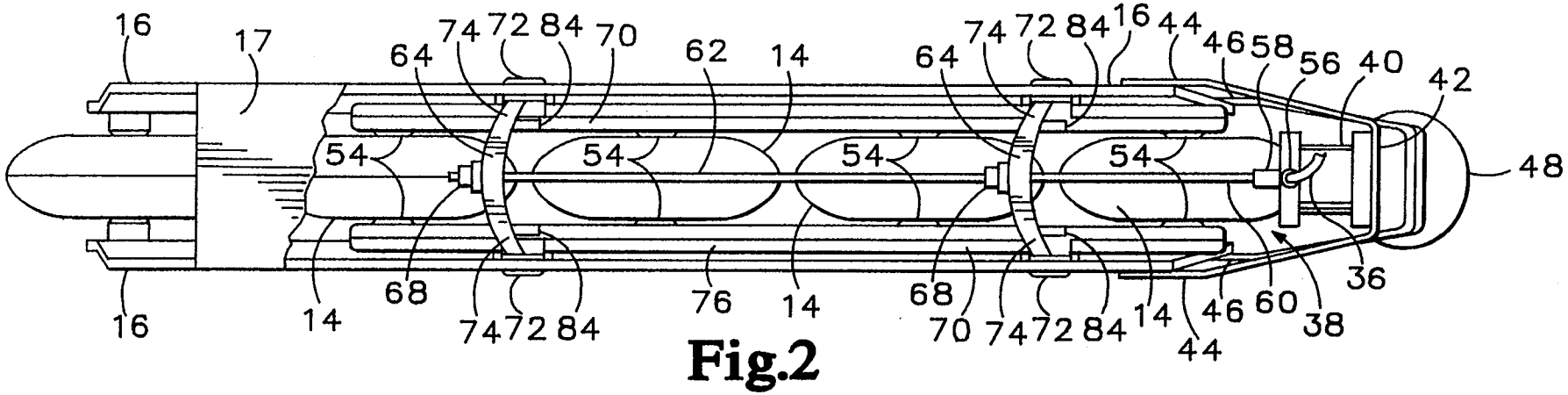
FIG. 2 is a top plan view of the hydraulic braking system of FIG. 1 shown for one skate with a portion of the boot and hydraulic system broken away.
Figure 3:
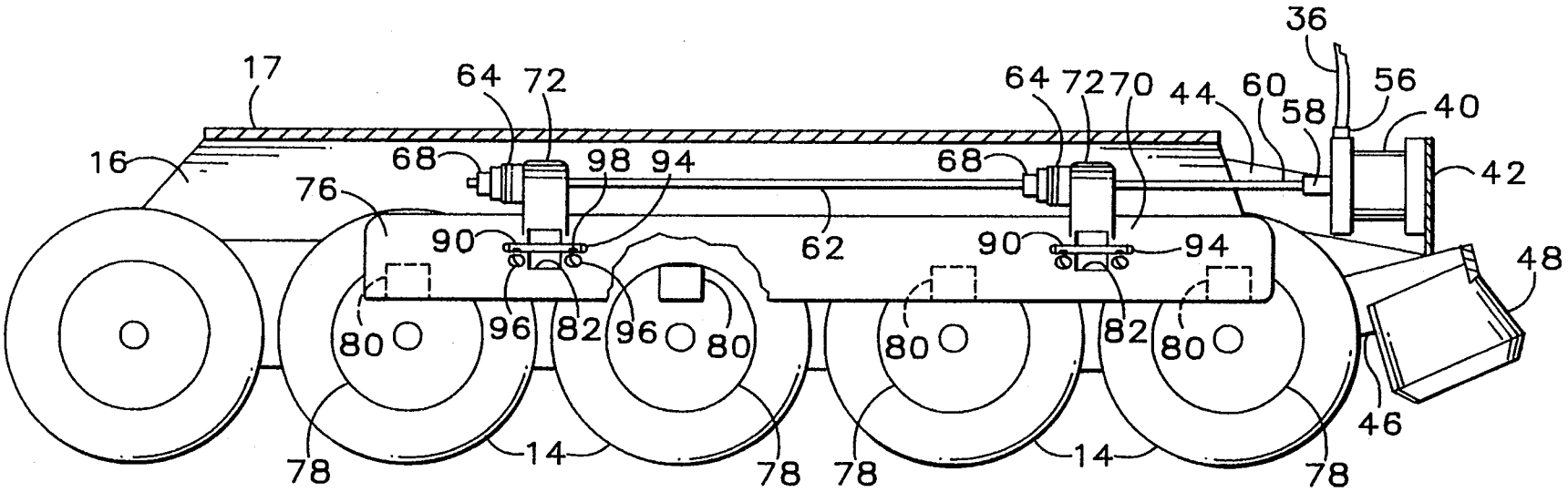
FIG. 3 is a side elevation view of the hydraulic braking system of FIG. 2 shown with a portion of the housing and hydraulic braking system broken away.

Referring now to FIGS. 2 and 3, the hydraulic fluid conduit 36 is coupled to an inlet aperture 56 of the hydraulic cylinder 40. The hydraulic cylinder 40 includes a piston 58 which is coupled to an end 60 of a rod 62 that extends longitudinally above the rollers 14 within the housing 16. At least one resilient expander bow 64 is mounted on the rod 62 in spaced relation from the end 60 of the rod 62 and secured in position by a ferrule 68. An engagement caliper 70 includes an upstanding portion 72 for contact with an end 74 of the resilient expander bow 64. The engagement caliper 70 is preferably an elongated caliper brake bar 76 pivotally mounted on the housing 16 between the housing and a side-wall 78 of the roller 14. A brake pad 80 is mounted on the caliper brake bar 76 proximate each roller sidewall 78. The brake pad is preferably made from a composite carbon/kevlar/epoxy material.

Figure 5:
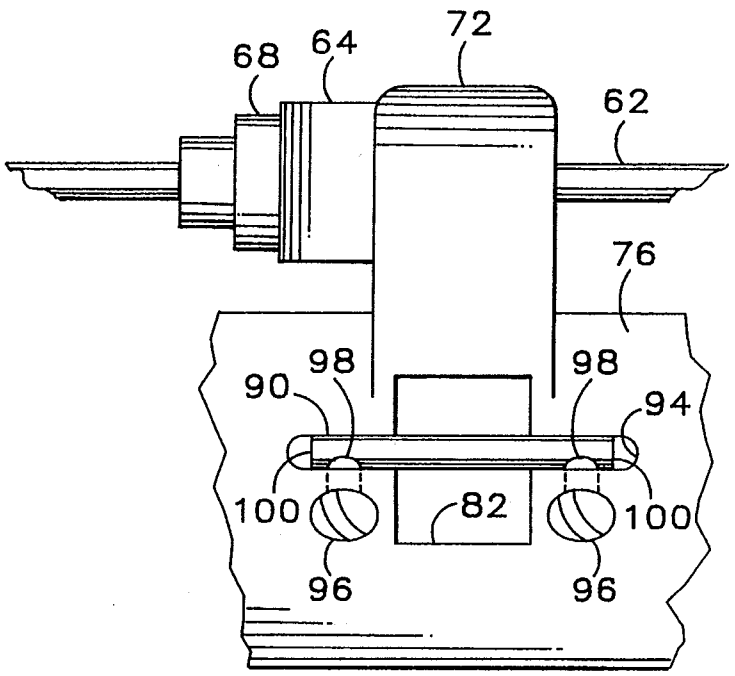
FIG. 5 is an enlarged view of a portion of the hydraulic braking system shown in FIG. 3.
Figure 4:
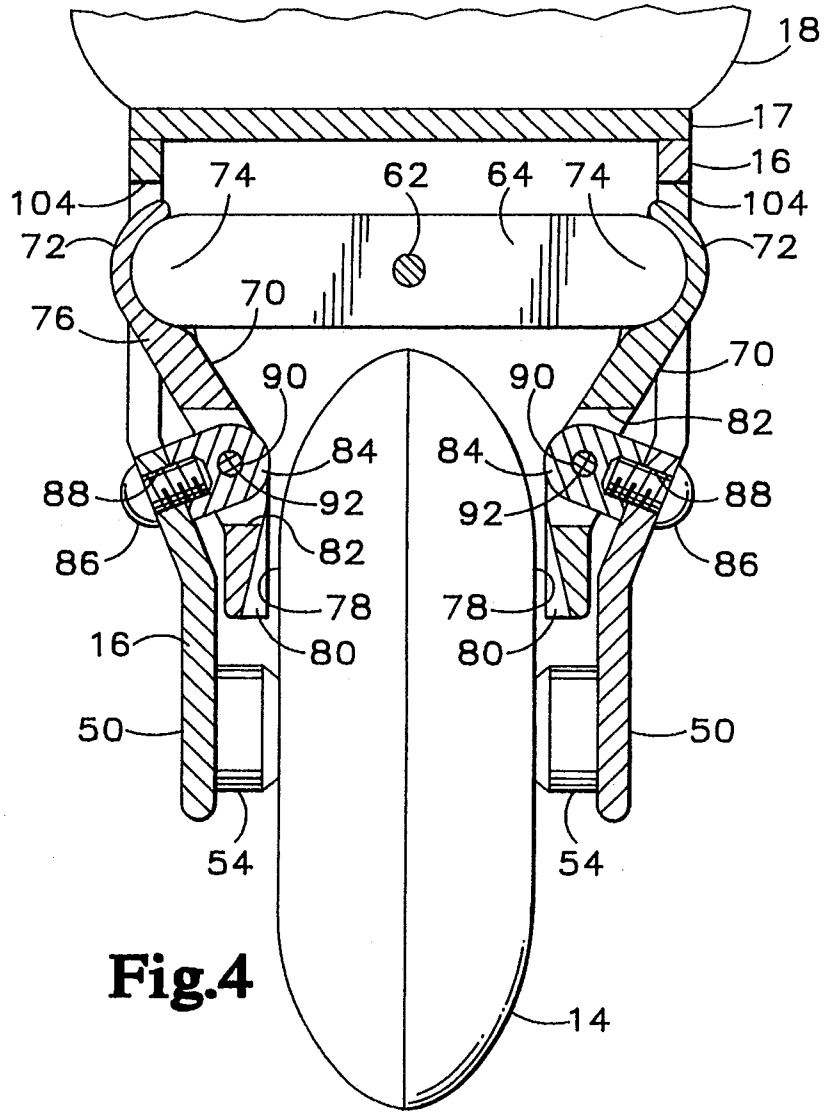
FIG. 4 is section view taken along line 4—4 of FIG. 1.

With particular reference to FIGS. 3–5, an opening 82 in the caliper brake bar 76 receives a hinge 84 which is secured to the housing 16 by a bolt 86 through a hole 88 in the housing 16. A pin 90 passes through a hinge bore 92 and is received in a pin seat 94 which is located in the caliper brake bar 76 adjacent the opening 82. A set screw 96 engages a recess 98 proximate an end 100 of the pin.

In operation, when hydraulic fluid passes through the aperture 56 into the hydraulic cylinder 40, the piston 58, which is normally forwardly biased by the resilient expander bow 64 through the rod 62, moves rearwardly causing rearward movement of the rod 62. As the rod 62 moves rearward, the attached resilient expander bow 64 straightens, and the end 74 of the expander bow pushes against the engagement caliper 70 at the upstanding portion 72 of the caliper brake bar 76. The upstanding portion 72 of the caliper brake bar moves outward through an aperture 104 in the housing 16 and the caliper brake bar 76 rotates about the hinge 84 to bring the brake pad 80 into frictional contact with the sidewall 78 of the roller 14. As the resilient expander bow, which may be made of a glass-filled nylon, returns to its arched position the above-described motion is reversed and the braking force is released. In a preferred embodiment of the present invention a caliper brake bar is mounted on each side of the housing proximate the rollers in each skate and a brake pad is mounted proximate the sidewall of each side of each roller to provide frictional braking force simultaneously in a pincer action to each roller on each skate.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A braking system for a pair of in-line roller skates, each roller skate including a plurality of rollers situated one behind the other along a line of directional travel of the skate, comprising:

(a) a single hand-operated hydraulic actuator;

(b) a hydraulic conduit system coupling the hydraulic actuator to each of said pair of roller skates, said conduit system having a coupling comprising an input from said actuator and two output lines; and (c) a hydraulic brake assembly located on each of said roller skates for applying braking force simultaneously to generally opposite sides of at least one of said rollers on each of said roller skates.

2. The braking system of claim 1 wherein said hand-operated hydraulic actuator includes a hand-held-body portion and a plunger portion coupled to a hydraulic cylinder.

3. The braking system of claim 1 wherein the hydraulic brake assembly includes a hydraulic cylinder and a piston, mounted at the rear of each of said skates.

4. The braking system of claim 3 wherein said piston is coupled by a mechanical link to a pair of engagement calipers for applying frictional pressure to a roller.

5. The braking system of claim 4 further including at least one pair of opposing brake pads mounted on said pair of engagement calipers for applying frictional pressure to opposite sidewalls of a roller.

6. The braking system of claim 4 including a housing wherein said pair of engagement calipers are pivotally mounted on said housing to apply frictional pressure to a roller with a pincer action.

7. The braking system of claim 4 wherein said mechanical link comprises:

(a) a rod having an end and extending longitudinally above said rollers, said end of said rod being connected to said piston; and (b) a resilient expander member having spaced apart ends and being mounted on said rod in spaced relation from said end of said rod, each said end of said resilient expander member contacting one of said engagement calipers for simultaneously pushing against said pair of engagement calipers.

8. The braking system of claim 1 wherein said hand-operated hydraulic actuator includes a wire link coupled to a hydraulic cylinder.

9. The braking system of claim 1 wherein the hand-operated hydraulic actuator includes a pistol grip portion and a lever portion coupled to a hydraulic cylinder.

* * * * *